US006138742A

United States Patent [19]

Billau

[11] Patent Number: 6,138,742

[45] Date of Patent: Oct. 31, 2000

[54] CONTACT POURING OF MOLTEN METAL FROM A VESSEL INTO A MOLD

[75] Inventor: Montgomery W. Billau, Harrison, Ark.

[73] Assignee: Inductotherm Corp., Rancocas, N.J.

[21] Appl. No.: 09/213,013

[22] Filed: Dec. 16, 1998

[51] Int. Cl.[7] ..... B22D 35/04

[52] U.S. Cl. ..... 164/133; 164/136; 164/337

[58] Field of Search ..... 164/133, 136, 164/337; 222/601, 602

[56] References Cited

FOREIGN PATENT DOCUMENTS

| | | | |
|---|---|---|---|
| 2811055 | 2/1963 | Germany | 164/337 |
| 917565 | 2/1963 | United Kingdom | 163/133 |

*Primary Examiner*—Kuang Y. Lin

*Attorney, Agent, or Firm*—Seidel, Gonda, Lavorgna & Monaco, PC

[57] ABSTRACT

An apparatus for and method of pouring molten metal from a refractory vessel into the sprue of a mold where the vessel is in contact with the sprue. Molten metal is poured through the orifice of a nozzle in the bottom of the vessel. Laminar flow and velocity of the molten metal through the orifice are controlled by a stopper that extends from the orifice and also displaces molten metal in the sprue of the mold when the stopper is in the closed position to minimize excess buildup of solidified metal in the volume of the sprue. Filtering of dross can be accomplished in the refractory vessel and heating means can be provided to hold the molten metal at the appropriate temperature.

11 Claims, 7 Drawing Sheets

CONTACT POURING OF MOLTEN METAL FROM A VESSEL INTO A MOLD

FIELD OF THE INVENTION

The present invention relates to the pouring of a molten metal from a vessel into a mold wherein the pouring nozzle of the vessel is in close contact with the sprue of the mold. The stopper for the nozzle provides a laminar flow of metal and precludes the presence of excess molten metal in the sprue.

BACKGROUND OF THE INVENTION

A molten metal, such as aluminum or an aluminum alloy, can be poured into a mold from a tundish. The tundish is a refractory vessel with one or more refractory nozzles located at its bottom or base. A ladle is typically used to transport the molten metal into the tundish from a melting or holding furnace. The molten metal in the tundish flows through the opening in the nozzle and into the sprue of a mold placed underneath it. The sprue originates on the exterior of the mold typically as a cup, or pouring basin, and defines the downward channel through which molten metal enters the mold cavity. The term sprue is generally used herein to describe the sprue cup or other structure into which molten metal is poured into the mold. The objective is to have the molten metal enter the mold cavity with a minimum of turbulence, exposure to air, and temperature loss, which will minimize oxidation and the formation of dross.

Typically, the nozzle of the tundish is a distance from the sprue when molten metal is poured. Consequently, the flow of metal from the nozzle to the sprue is relatively uncontrolled and occurs in air. The turbulence in air accelerates oxidation, which degrades the pouring process. Uncontrolled flow in air can lead to undesired splashing of the molten metal. As the mold is topped off, it is difficult to control the presence of excess molten metal in the top of the sprue. Bringing the nozzle in close contact with the sprue eliminates some of these problems. However, this alone will neither ensure a laminar flow through the opening in the nozzle and into the sprue nor prevent the presence of excess molten metal in the sprue.

The present invention provides for the pouring of molten metal from a vessel while the vessel's pouring nozzle is in close contact with the mold, and associated components, particularly the stopper rod, extend into the mold sprue. Since the opening in the nozzle is at a minimum height above the sprue, flow of the metal through the opening is at a relatively low velocity. This flow condition will minimize downsprue turbulence. Flow of the molten metal through the opening in the nozzle is controlled with a stopper that produces a smooth laminar flow through the opening when the stopper is in the opened position. In the closed position, the stopper prevents flow through the opening in the nozzle. More important, since the stopper protrudes through the opening in the nozzle and partially into the sprue when the stopper rod is in the closed position, excess molten metal is eliminated in the sprue at the end of the mold filling process. By eliminating this excess, a cumulative savings in molten metal can be realized.

SUMMARY OF THE INVENTION

In its broad aspects, the present invention is a vessel for pouring a molten metal through the opening in the nozzle of the vessel into the sprue of a mold that is placed in close contact with the vessel. The stopper used to control flow of the molten metal protrudes through the orifice and displaces excess molten metal in the sprue when the stopper is in the closed position. Generally, the opening in the nozzle and the stopper will be cylindrical in shape. A launder can be provided in the side of the vessel for filling the vessel with molten metal in a manner that will minimize the disturbance of surface dross formed from molten metal already in the vessel. A filter may be included in the vessel to eliminate dross from the molten metal prior to pouring the metal out of the opening in the nozzle and into the sprue of the mold. A controlled heating element can be provided in the vessel to maintain the molten metal at a desired temperature as molds are being filled.

In another aspect, the present invention is a tundish assembly with apparatus that will horizontally position a tundish with a pouring nozzle over a mold so that the opening in the nozzle is over the sprue of the mold, and positioning apparatus that will raise and lower the tundish so that the opening in the nozzle of the tundish can be brought in close contact with the sprue. Once the opening is in close contact with the sprue, a stopper positioned in the opening of the nozzle can be used to control flow of the molten metal and displace excess molten metal in the sprue when the stopper is in the closed position. Generally, the opening in the nozzle and the stopper will be cylindrical in shape. A launder can be provided in the side of the tundish to fill the vessel with molten metal in a manner that will minimize the disturbance of surface dross formed from molten metal already in the tundish. A filter may be included in the tundish to eliminate dross from the molten metal prior to pouring the metal out of the opening in the nozzle and into the sprue of the mold. A controlled heating element can be provided in the tundish to maintain the molten metal at a desired temperature as molds are being filled.

In still another aspect of the invention, the present invention is a method for pouring molten metal from a vessel into the sprue of a mold by bringing the opening of the nozzle in the vessel in close contact with the sprue of the mold and raising a stopper that seats in the closed position in the opening of the nozzle. When a mold is filled with molten metal, the stopper is lowered to once again seat in the closed position to terminate the flow of metal from the vessel. In addition to terminating the flow of molten metal through the opening in the nozzle, the stopper protrudes through the opening in the vessel to displace excess molten metal in the sprue of the mold.

These and other aspects of the invention will be apparent from the following description and the appended claims.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
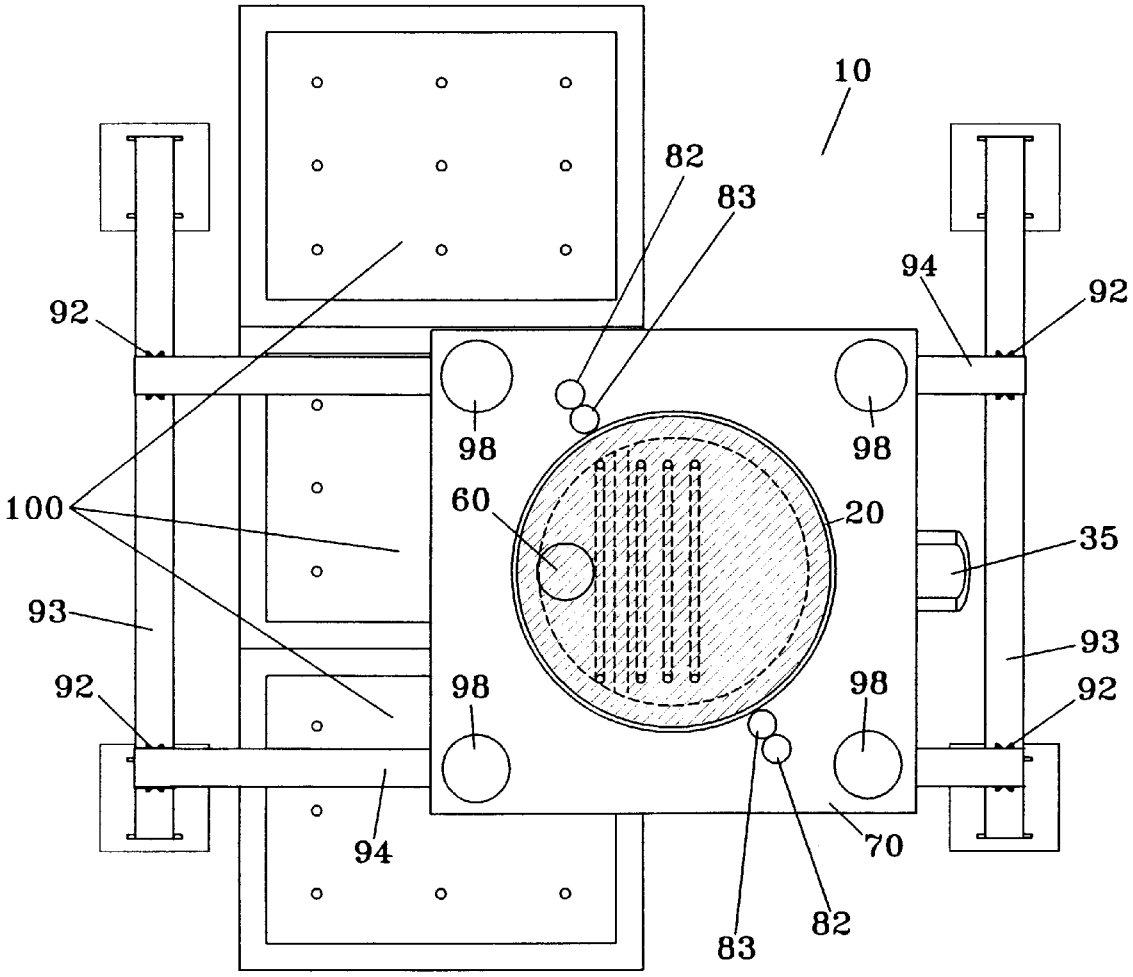
FIG. 1 is a top view of a mold-filling production line and the pouring tundish assembly of the present invention.
Figure 2:
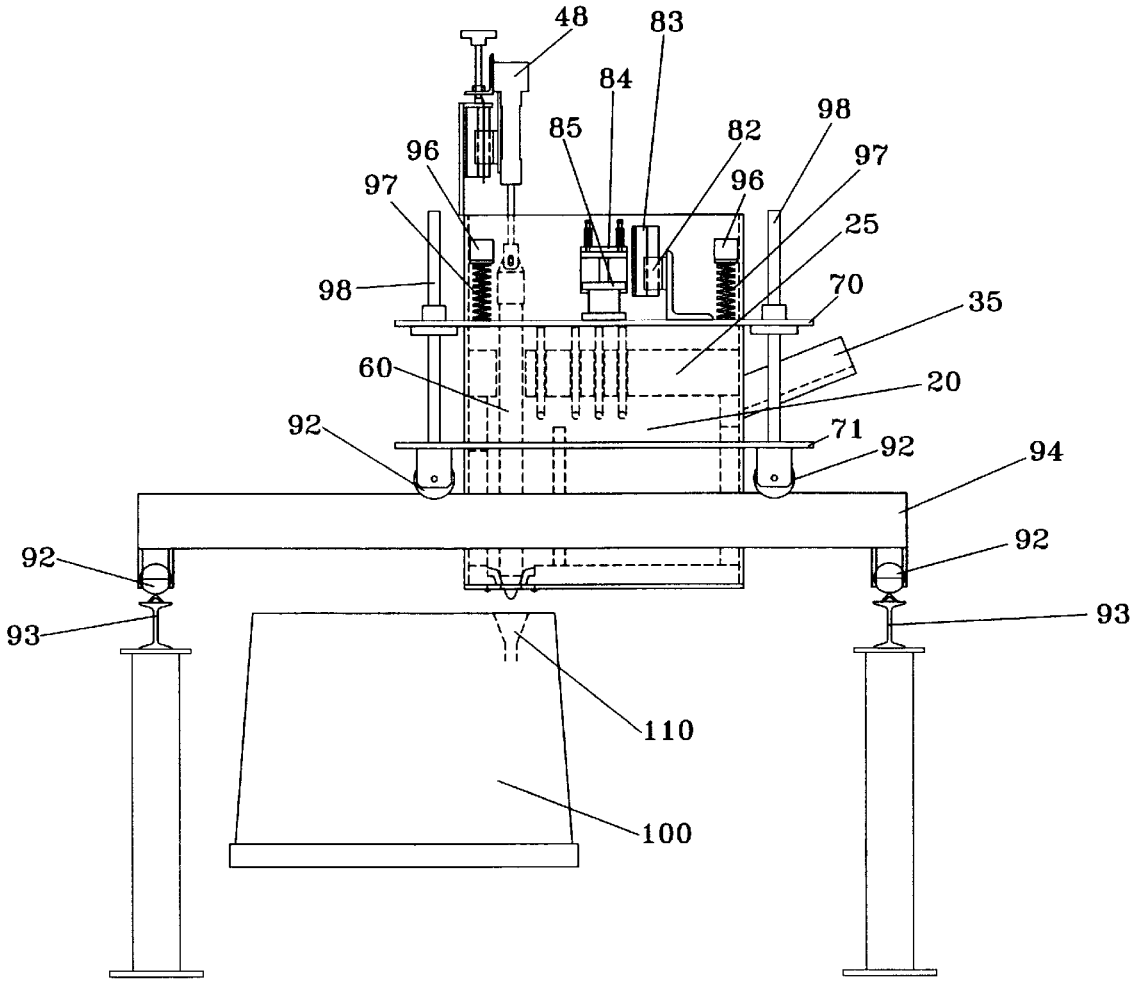
FIG. 2 is a partial cross-sectional view of the tundish assembly of the present invention with the stopper in the closed position, and the tundish in the raised (non-pouring) position above a mold.
Figure 3:
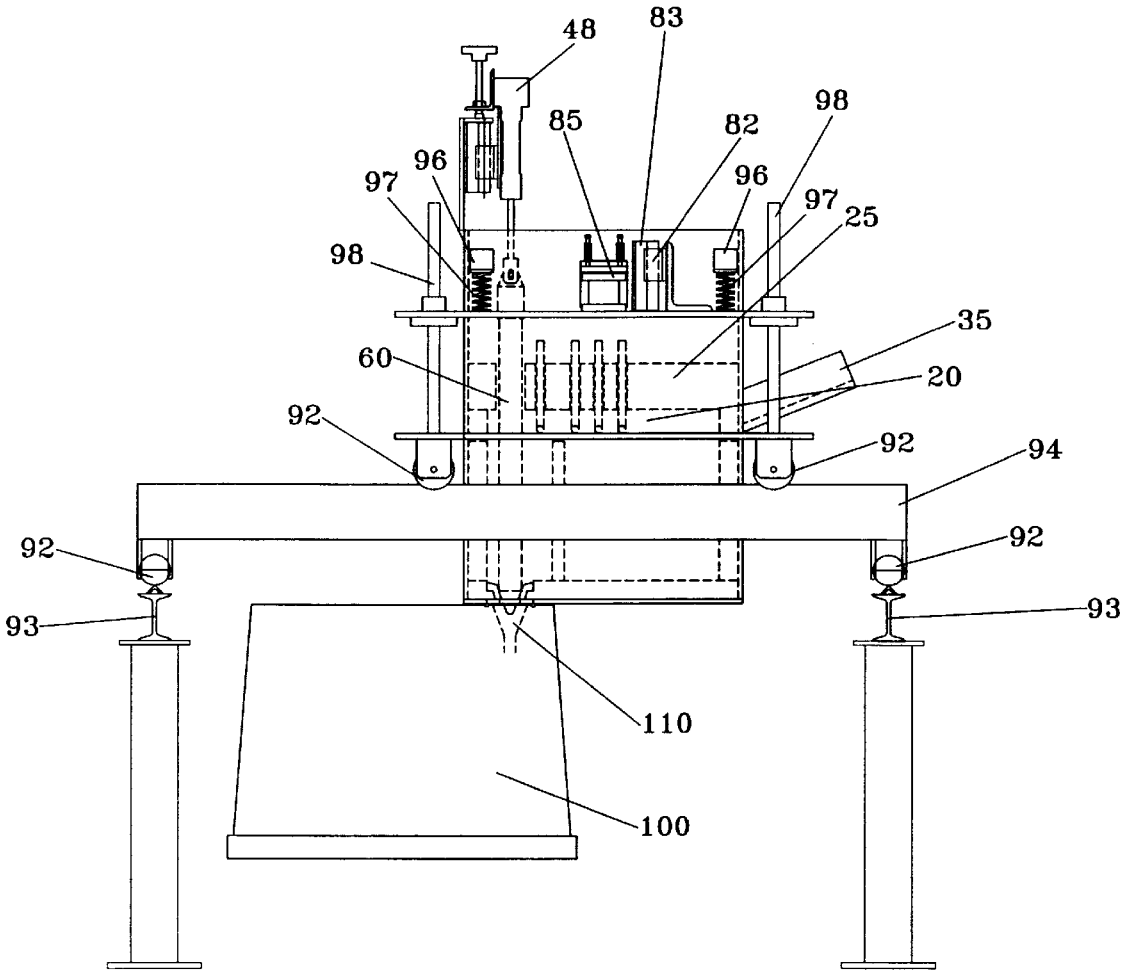
FIG. 3 is a partial cross-sectional view of the tundish assembly of the present invention with the stopper in the closed position, and the tundish in the lowered (pouring) position over an indexed mold.
Figure 4:
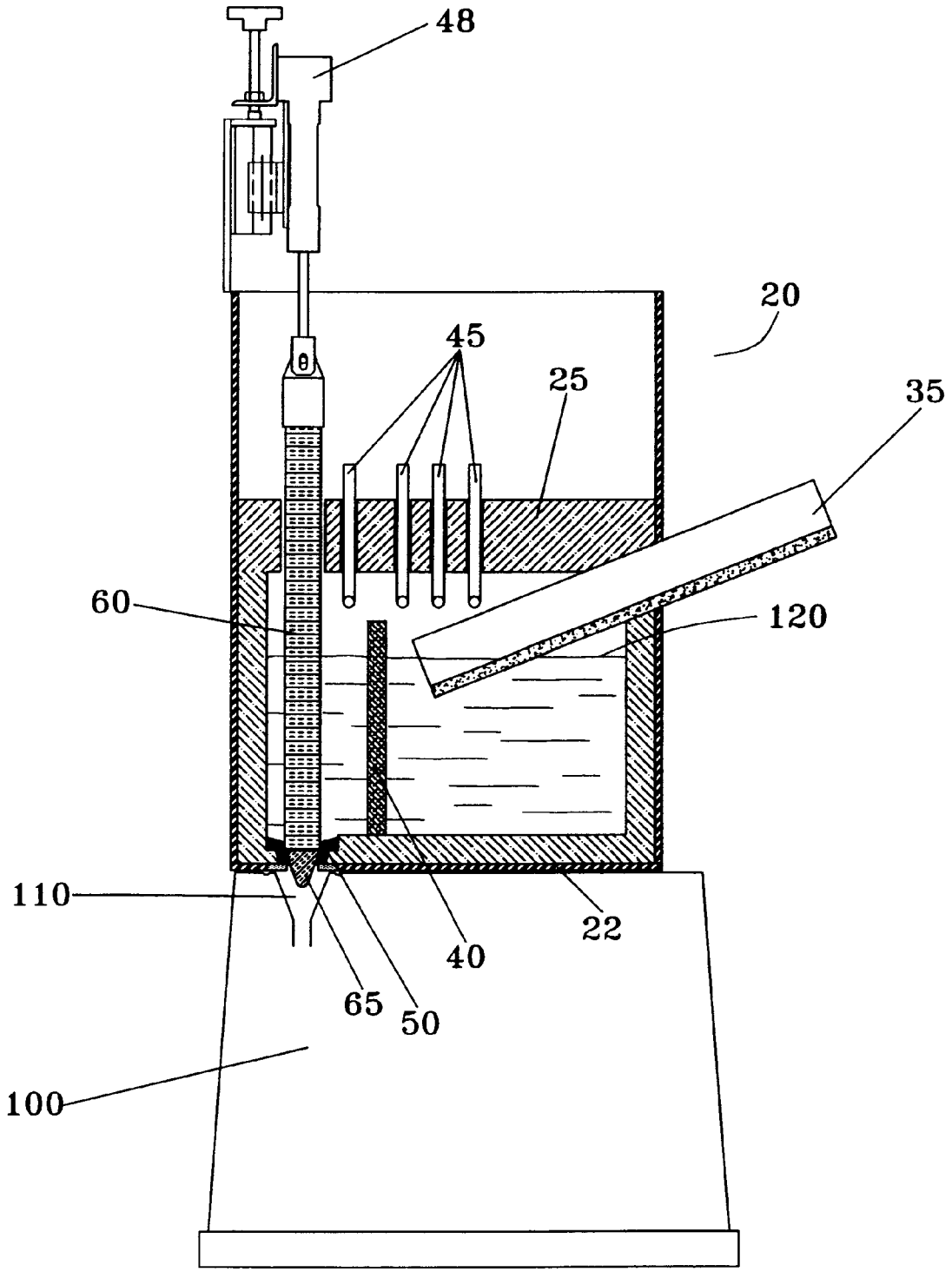
FIG. 4 is a cross-sectional view of the tundish of the present invention with cut away section showing details of the interior of the tundish.

Referring now to the drawings, wherein like numerals indicate like elements, there is shown in FIGS. 1 through 3, a tundish assembly 10 and molds 100 in accordance with the present invention. The tundish assembly 10 comprises a tundish 20, tundish mounting structure, and tundish positioning systems. The tundish 20, most clearly shown in FIG. 4, is used to fill the mold 100 with molten metal. Tundish 20 is constructed from refractory material suitable for use with the molten metal. One construction method for a tundish is to use a metal structural foundation coated with a vacuformed ceramic fiber product. The overall shape of the tundish, which is shown as a circular cylinder in the drawings, can be varied without deviating from the scope of the invention. While the apparatus and method are described for use with molten aluminum and aluminum alloys, an artisan will appreciate that with appropriate modifications, the disclosed invention can be used for the contact pouring of other metals. Typically, for molten aluminum, mold 100 will be a sand-cast mold. With modifications, the tundish 20 can be used with other types of molds, such as permanent molds, to achieve contact pouring from the tundish to the mold.

Lid 25 encloses the top of tundish 20. As shown in the figures, the wall of the tundish extends above the lid to provide a convenient location for auxiliary equipment associated with operation of the tundish. The top of the wall of the tundish 20 can be made level with the lid 25 without deviating from the scope of the invention. In that instance, separate supporting structure would be provided for the auxiliary equipment. The lid provides thermal insulation to retain heat in the tundish and an air barrier to limit oxidation on the surface of the molten metal in the tundish. An opening is provided in lid 25 to allow stopper rod 60 to extend through the lid of the tundish and connect to actuator 48.

In a typical operation, a mold 100 to be filled from the tundish 20 is indexed under the tundish by a conveyor or other mold line transporting mechanism. The term "indexed" is used to describe the positioning of a mold 100 relative to the tundish 20 so that the center of the sprue is approximately vertically aligned with the tip of stopper 65. The tundish 20 is provided with a minimum of two positioning systems. An x-y axes positioning system permits orthogonal movement of the tundish 20 in a generally horizontal plane that is perpendicular to the movement of the stopper rod. As shown in the drawings, the x-y axes positioning system comprises wheels 92 attached to the tundish assembly's structural support element 71, and cross-rails 94. With this x-y axis positioning system, the tundish and supporting structural elements are manually rolled into the appropriate indexing position along rails 93 and cross-rails 94. A manual x-y axis positioning system is primarily of use in a production line that will require an initial positioning suitable for use in a process in which many molds of one size are filled. Consequently, infrequent adjustments are required. While a manual x-y axis positioning system is shown, other positioning systems known in the art, for example, a hydraulic or spring-loaded system, or alternative manual system, could be used. A mold is in the proper position for filling, or indexed, when the sprue 110 of the mold 100 is centered by the x-y positioning system wider the tip of stopper 65.

A z-axis positioning system moves the tundish in a plane perpendicular to the plane of the x-y positioning system, and lowers the tundish when the next mold is indexed for filling and raises the tundish after a mold is filled. Generally, the z-axis positioning system will consist of coarse manual height adjusting hardware and fine automatic height adjusting hardware. Manual height adjustment will be made to accommodate a particular mold design. Automatic height adjustment is made when indexing the molds to be filled. Typically, this automatic height adjustment should be as small as possible to clear the height of the molds when the molds are indexing. A travel distance of 2 inches should be adequate with most mold designs. While a combination manual and automatic z-axis positioning system is described, a totally manual or automatic z-axis positioning system can be used without deviating from the scope of the present invention.

As shown in the drawings, the z-axis positioning system comprises manual height adjusting hardware and automatic height adjusting hardware. The manual height adjusting hardware comprises four coil springs 97 held in place by the four retaining devices 96, which are attached to the extended wall of the tundish 20 and the structural support element 70. Manual height adjusting devices 98 that can be used to either increase or decrease the height of the tundish 20 by either raising or lowering the structural support element 70 relative to retaining devices 96. The springs will further compress as molten metal is poured into the tundish. Two hydraulic units 85, attached to the extended wall of the tundish 20 and the structural support element 70 are used to raise and lower the tundish 20 as molds are indexed under the tundish for filling. Vertical guide rails 83 slide in guide rail supports 82 to assist in keeping the tundish in position as it is raised or lowered. While a combination spring loaded and hydraulic z-axis positioning system is shown, other positioning systems known in the art, for example, a totally hydraulic system, or alternative spring-loaded system, could be used.

The tundish 20 includes a launder 35 for filling the tundish with molten metal. As molten metal is bottom-poured from the tundish 20, additional molten metal can be added to the tundish from a ladle or other equipment by pouring it into the launder. Launder 35, as shown in the figures, rakes from the side of the tundish 20 toward its bottom. Additional molten metal poured into the launder 35 will flow in the launder toward the bottom of the tundish. The advantage of this type of filling is that the surface layer 120 of the molten metal in the tundish 20 will be minimally disturbed. For many molten metals, a metal oxide layer, or skin, will rapidly form at the molten metal and air interface. Avoiding the disturbance of the formed oxide skin minimizes the formation of additional oxide that will increase dross. Although less preferable, molten metal can be added to the tundish through the top, by either raising the lid 25 or providing an opening in the lid.

Filter 40, as shown in the drawings, traps impurities in the molten metal. Bonded particle, ceramic cellular, and ceramic foam are suitable filter media. For aluminum and aluminum alloys, a bonded silicon carbide filter medium, available from Metaullics Systems Company, is preferred. While the filter 40 is shown in the figures as dividing the entire volume of the tundish 20 into filtered and unfiltered sections, suitable filtration may be achieved with a filter that is shorter than the full height of the tundish. The ratio of the volumes of filtered and unfiltered sections in the tundish will also vary depending upon a particular application. The principal impurity, or dross, to be trapped by the filter is the oxide of the metal. Preferably, the mounting structure (not shown in the drawings) for the filter 40 in the tundish 20 allows rapid removal and insertion of the filter for periodic replacement. The filter 40 may also be permanently fixed in the tundish 20. As molten metal flows through the tundish 20, filter 40 traps the dross and the filtered molten metal flows into a mold through the opening in the nozzle in the bottom of the tundish 20 as further described below.

Heating elements 45 are used to keep the molten metal at a preselected temperature. A temperature sensing device, not shown in the drawings, such as a thermocouple, can be placed in the tundish 20 to monitor the temperature of the molten metal. The temperature sensing device can be connected to a controlled power source that provides the appropriate amount of controlled heating to the heating element 45. The heating elements 45 can be one or more electrical resistance heating elements made of silicon carbide. Other types of heating systems, such as induction, may be employed without deviating from the disclosed invention.

Figure 5A:
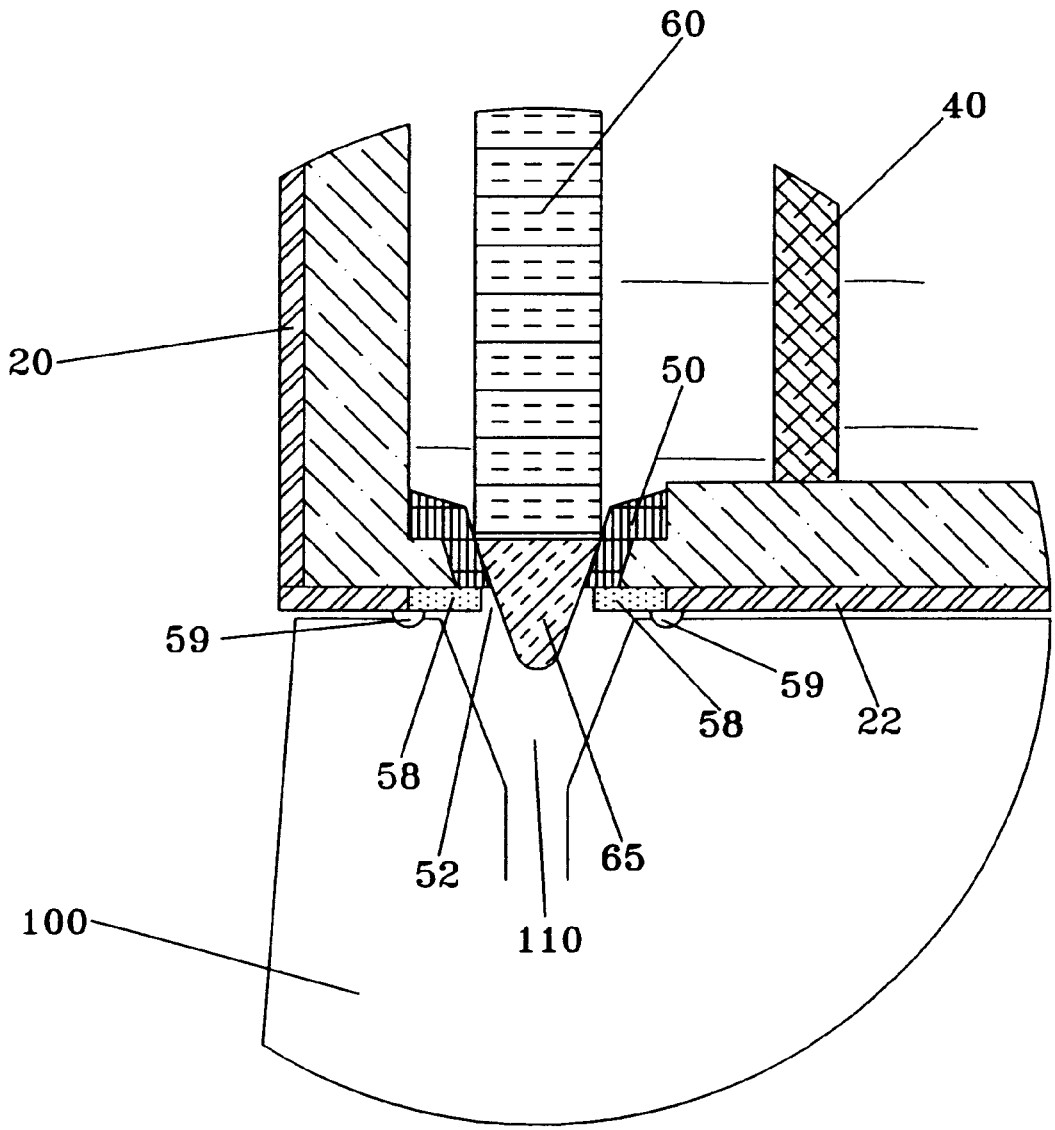
FIG. 5*a* is a cross-sectional detail of the tundish of the present invention with the stopper in the closed position and the tundish in the lowered (pouring) position over an indexed mold.
Figure 5B:
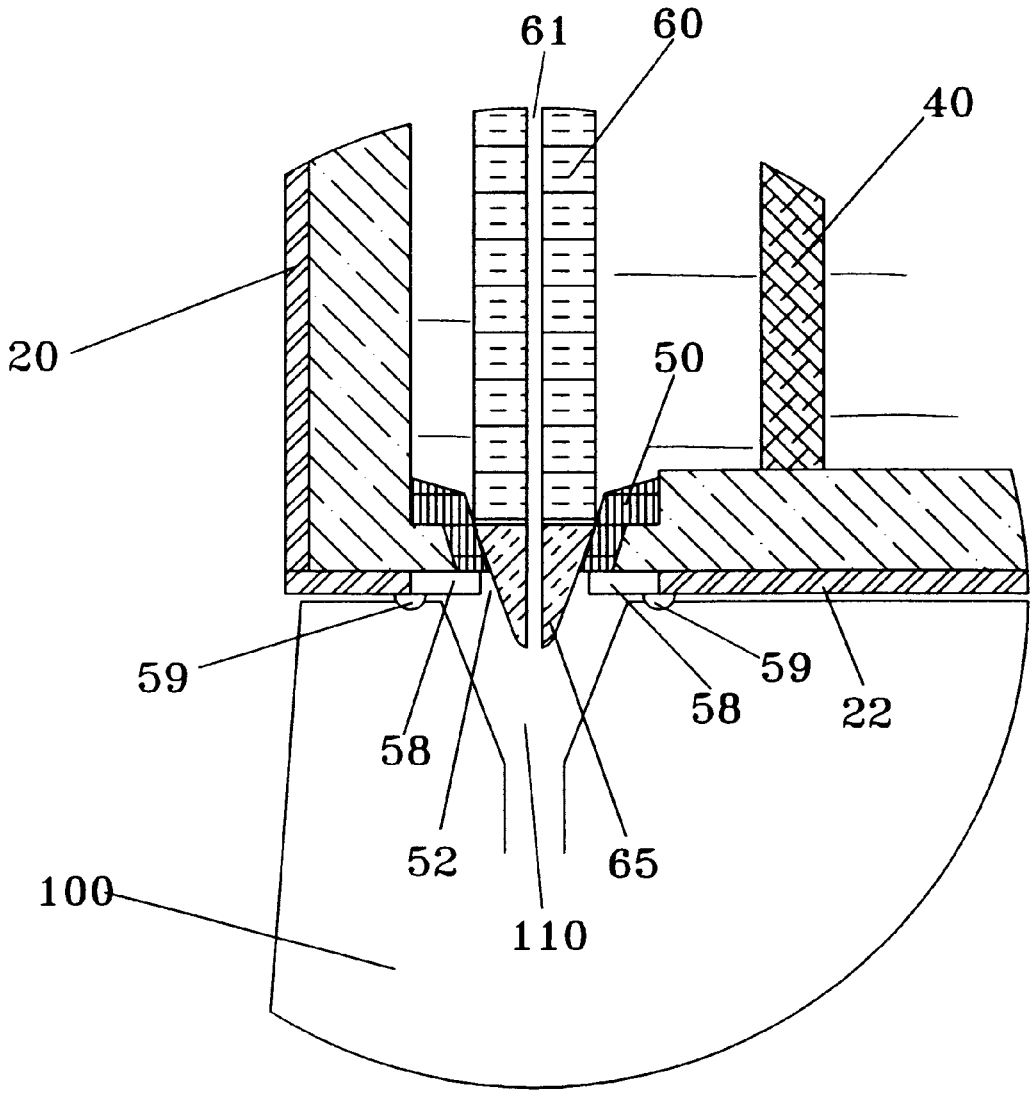
FIG. 5*b* is a cross-sectional detail of the tundish of the present invention with the stopper in the closed position and optional means for injecting inert gas into the sprue.
Figure 6:
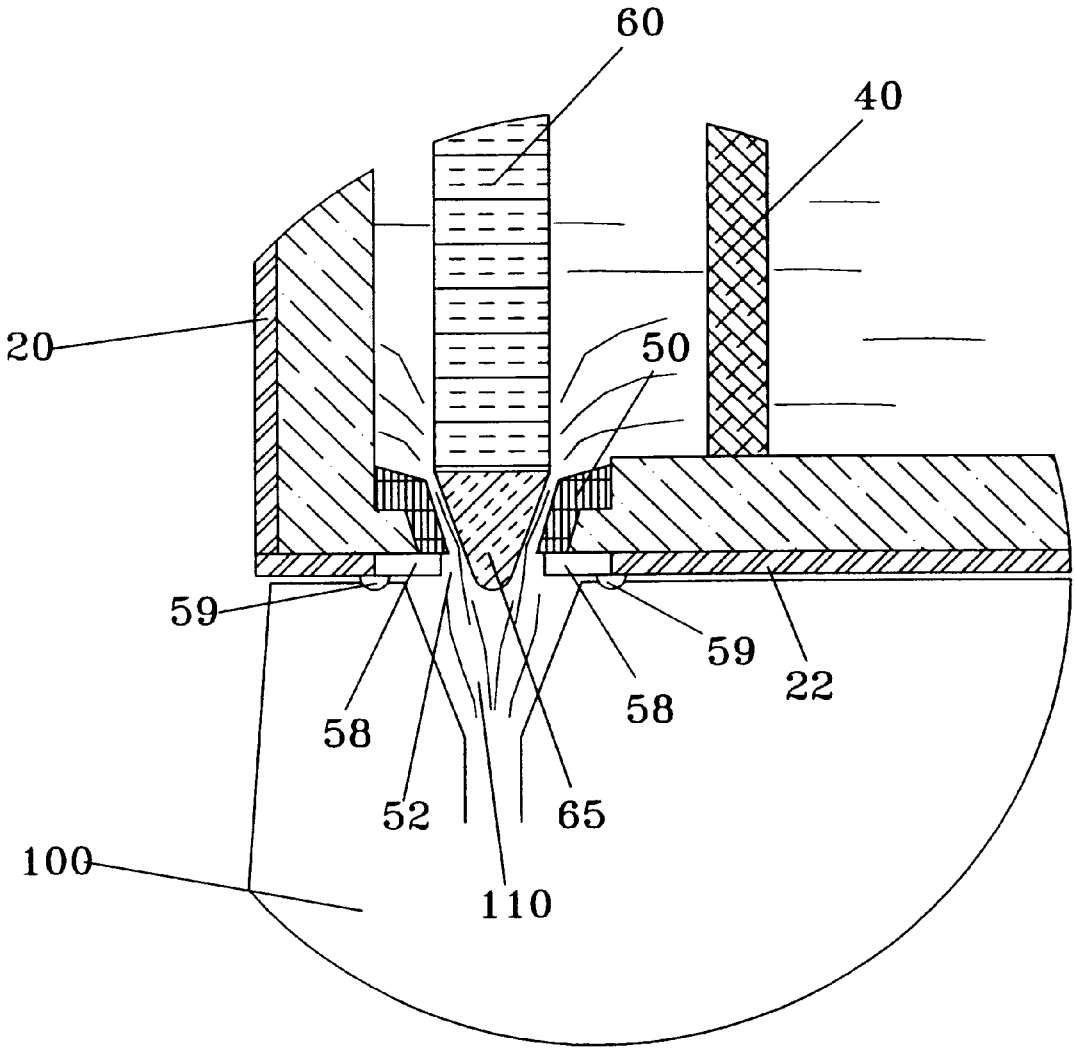
FIG. 6 is a cross-sectional detail of the tundish of the present invention with the stopper in the opened position and the tundish in the lowered (pouring) position over an indexed mold.

Nozzle 50, as best shown in FIG. 5*a*, 5*b* and 6, provides the opening 52 in the bottom 22 of the tundish 20 through which the molten metal flows out of the tundish and into the mold 100. The nozzle can be fabricated from suitable refractory material, such as fused silica. A sealing element 58 can be mounted below the nozzle 50 in the bottom 22 of the tundish. As shown in the figures, the sealing element 58 is an open disk-shaped plate centered on the center of nozzle's opening. The inside diameter of the sealing ring is preferably slightly larger than the diameter of nozzle's opening adjacent to the ring. If desired, the sealing ring can be extended beyond the bottom of the tundish to prevent the entire bottom of the tundish from making contact with the mold. The scaling ring 58 can be made of stainless steel and be of different shapes from that shown in the drawings.

To limit surface contact between the tundish and the mold, a circular weld bead 59 can be provided on the bottom of the tundish to establish a small offset distance between the bottom and the top of the mold 100. A circular weld bead or other offset element will not be required in all applications, since direct contact of the entire bottom of the tundish with the top of the mold is permissible in some applications.

One end of the stopper rod 60 protrudes vertically through the lid 25 of the tundish. The opposite end of the stopper rod 60 terminates in a generally conical-shaped stopper 65. The stopper 65 protrudes through the orifice 52 in nozzle 50. The orifice 52 is generally in the shape of a conic frustum. The stopper 65 is substantially conical in shape. Consequently, the stopper, in the closed position, normally seats on the wall of the nozzle 50 as shown in FIG. 5*a* to close the flow path through the nozzle. When the stopper rod 60 and attached stopper 65 are raised to the open position as shown in FIG. 6, the flow path through nozzle 50 is opened and molten metal flows from the tundish 20 into the sprue 110 of the mold 100. The conically-shaped stopper 65 establishes a smooth laminar flow through the nozzle 50. Minimal turbulence of the molten metal through this flow path enhances the flow of the metal into the mold. The distance that the stopper rod is raised off of its seat in the nozzle 50 will determine the flow velocity and pressure through the nozzle and into the mold. During the filling process, the position of the stopper can be continuously moved to any position between fully opened and closed to accomplish a controlled fill profile for a particular mold. With the stopper raised as shown in FIG. 6, the molten metal is poured at an increased pressure while still maintaining minimum velocity through the opening. Once the mold has been filled, the stopper rod 60 is lowered to seat the side of the stopper 65 on the wall of the nozzle 50. At the same time, the tip of the stopper 65 protrudes into the sprue 110 to displace molten metal from the sprue. Consequently, stopper 65, in addition to closing the flow path through the nozzle, also minimizes the buildup of excess molten metal around the orifice and in the sprue. This excess molten metal has a tendency to solidify between the filling of molds, and the filing process must be stopped to clear the solidified metal. Consequently, reducing this accumulation of solidified metal will minimize the downtime required for clearing the orifice of the nozzle. Additionally, eliminating excess molten metal in the sprue will avoid overflowing of the sprue as a pour is completed.

FIG. 5*b* illustrates an alternative stopper with an internal passage 61 extending through the length of stopper rod 60 and stopper 65. An inert gas can be supplied under pressure from an external source through the internal passage 61 and into the mold prior to the filling of the mold. The inert gas will displace air in the mold prior to filing it with molten metal, which will decrease the amount of metal oxidation during the filling process. An artisan will appreciate that other methods of injecting the inert gas into the mold can be used without deviating from the scope of the present invention.

Although not required, it is beneficial to slightly rotate the stopper rod 60 and associated stopper 65 when it is lowered and seated to provide a slight abrasion action on the seating surfaces, which will avoid the buildup of impurities. A thin gasket material (not shown in the drawings), can be placed between sealing ring 58 and the surface of the mold surrounding the sprue to eliminate any adhesive effect between the weld bead 59 and the top of the mold 100. Similarly, if the weld bead is not used, then a suitable gasket can be fabricated to eliminate any adhesive effect between the bottom 22 of the tundish and the top of the mold 100. One suitable material for the gasket is paper fiber.

A preferred stopper is substantially in the shape of a right circular cone, with a cone angle of approximately 40 degrees, and the vertex of the cone rounded to a radius as shown in the figures. The stopper rod 60 and associated stopper 65 can be cast in fused silica. An artisan will appreciate that the specific shape of the stopper can be varied to meet the shape of a specific nozzle's opening and the geometry of the opening in the sprue.

When a mold to be filled properly indexes wider the tundish 20 as described above, the tundish 20 is lowered by the z-axis positioning system to seat the bottom 22 of the tundish, or weld bead 59, if used, on top of the mold 100 to establish a closed flow path between the tundish's nozzle 50 and the sprue 100. At the same time, the stopper 65 protruding through the nozzle 50 seats in the sprue 110. The sprue, now sealed with the twidish's nozzle, can be totally flooded by raising the stopper rod. The metal being poured is at an increased pressure while still at a minimum velocity. This allows the mold to be poured more quickly than by conventional pouring techniques.

A computer can be used to automatically control the positioning systems for the tundish 20 and filling time of a mold 100. The mold line is in a fixed position relative to the cross-rails 94. Thus, a particular mold's dimensions are used to calculate the appropriate location in an x, y and z orthogonal coordinate system that the tundish has to be moved to make close contact with the mold sprue. Initially, the tundish, with the stopper in the closed position, must be raised by the z-axis positioning system to a minimum height that will clear the top of the mold. The tundish 20 is moved manually or automatically to position the stopper over the center of the mold sprue by the x-y axes positioning system. The tundish 20 is then automatically lowered by the computer control system to the required z-axis position for the mold to be filled.

The computer, by appropriate actuator 48, moves the stopper to the opened position. A predetermined fill time for a particular mold is used to determine the period of time that the stopper must be in the open position. Sensing systems, such as video sensing of a filled sprue or load cells to determine the amount of metal poured from the tundish, can be used to establish the fill time for a mold. At the end of that time period, the actuator 48 moves the stopper to the closed position. The actuator 48 can also be used to rotate the stopper about the stopper rod axis to affect abrasive action of the stopper 65 as it seats on the nozzle 50. The tundish 20 is then automatically raised by the computer control system to the height required so that the stopper will clear the top of the mold. The mold line is then activated by computer control to move the next mold to be filed under the tundish. The described control system could also be entirely manually controlled, or could be a mixed automatic and manual system.

Multiple nozzles could be placed on the bottom of the tundish to fill multiple molds at the same time.

The present invention may be embodied in other specific forms without departing from the spirit or essential attributes thereof. Accordingly, reference should be made to the appended claims, rather than to the foregoing specification, as indicating the scope of the invention.

What is claimed is:

1. A casting assembly including a vessel and a mold having a sprue, wherein said vessel adapted for pouring a molten metal into the sprue of a mold in close contact with said vessel, the vessel comprising:

an inlet for filling the vessel with molten metal;

a nozzle disposed in the bottom of the vessel, the nozzle having an orifice with an outlet opening substantially flush with the bottom of said vessel; and a stopper to control the flow of the molten metal through the orifice, the wall of said stopper making surface contact with the wall of said orifice and the stopper, when in a closed position, protruding through the nozzle to displace molten metal in the sprue.

2. The vessel in claim 1 wherein the nozzle and stopper are substantially conical in shape and the cone angles of said nozzle and stopper are substantially equal.

3. The vessel in claim 1 wherein the inlet comprises a launder extending through the wall of said vessel.

4. The vessel of claim 1 further comprising a filter to remove dross from the molten metal in said vessel.

5. The vessel of claim 1 further comprising a sealing member surrounding the outlet opening and having its outer surface substantially flush with the bottom of said vessel.

6. A casting assembly including a tundish assembly and a mold having a sprue, wherein said tundish assembly adapted assembly for pouring a molten metal from a vessel into the sprue of a mold in close contact with said vessel, the assembly comprising:

an inlet for filling the vessel with molten metal;

a nozzle disposed in the bottom of the vessel, the nozzle having an orifice with an outlet opening substantially flush with the bottom of said vessel;

a stopper to control the flow of the molten metal through the orifice, the wall of the stopper making surface contact with the wall of said orifice and the stopper, when in a closed position, protruding through the nozzle to displace said molten metal in the sprue;

a horizontal plane positioning system for indexing the vessel over the mold to position the nozzle over the sprue; and a vertical positioning system for lowering the refractory vessel to make close contact between the orifice and said sprue.

7. The vessel in claim 6 wherein the nozzle and stopper are substantially conical in shape and the cone angles of said nozzle and stopper are substantially equal.

8. The vessel in claim 6 wherein the inlet comprises a launder extending through the wall of said vessel.

9. The vessel of claim 6 further comprising a filter to remove dross from the molten metal in said vessel.

10. The vessel of claim 6 further comprising a sealing member surrounding the outlet opening and having its outer surface substantially flush with the bottom of said vessel.

11. A method of pouring molten metal from a vessel into the sprue of a mold, the method comprising:

providing a vessel for holding the molten metal, the vessel having at least one nozzle with an orifice in the bottom of said vessel, the orifice having an outlet opening substantially flush with the bottom of said vessel, and a stopper to control the flow of said molten metal from the vessel through said orifice;

filling the vessel with molten metal;

indexing a mold having a sprue under the vessel;

adjusting the position of the vessel so that the sprue of the mold is substantially in alignment with the orifice of said nozzle;

lowering the vessel to bring the orifice in close contact with the sprue;

raising the stopper to allow molten metal to flow from the vessel through the opening bounded by the walls of the nozzle and stopper and then to the sprue;

lowering the stopper to seat the wall of said stopper on the wall of the orifice with the stopper extending at least partially from the orifice to terminate the flow of molten metal and displace molten metal in the sprue; and raising the vessel to permit removal of the mold.

* * * * *